US006851349B2

(12) United States Patent
Dohallow

(10) Patent No.: US 6,851,349 B2
(45) Date of Patent: Feb. 8, 2005

(54) BLEEDERLESS TELESCOPIC CYLINDER

(75) Inventor: Douglas Dohallow, Sharon, PA (US)

(73) Assignee: Parker-Hannifin Corporation, Cleveland, OH (US)

( * ) Notice: Subject to any disclaimer, the term of this patent is extended or adjusted under 35 U.S.C. 154(b) by 55 days.

(21) Appl. No.: 10/382,733

(22) Filed: Mar. 5, 2003

(65) Prior Publication Data

US 2003/0167916 A1 Sep. 11, 2003

Related U.S. Application Data

(60) Provisional application No. 60/361,843, filed on Mar. 5, 2002.

(51) Int. Cl.[7] ..... F01B 7/20
(52) U.S. Cl. ..... 91/169; 92/53
(58) Field of Search ..... 91/167 R, 169, 91/173, 181; 92/52, 53, 164

(56) References Cited

U.S. PATENT DOCUMENTS

| | | | | |
|---|---|---|---|---|
| 732,142 A | | 6/1903 | Tuggle et al. | |
| 2,308,761 A | * | 1/1943 | Komph, Sr. | 92/53 |
| 2,692,584 A | | 10/1954 | Armington et al. | |
| 3,452,647 A | * | 7/1969 | Herrell | 92/53 |
| 4,303,005 A | * | 12/1981 | Glomski et al. | 92/53 |
| 4,471,944 A | | 9/1984 | Leray et al. | 92/53 |
| 4,516,468 A | * | 5/1985 | Sheriff | 92/52 |
| 5,072,811 A | | 12/1991 | Everhard | 92/52 |
| 5,099,748 A | | 3/1992 | Neubauer | 92/52 |
| 5,322,004 A | | 6/1994 | Sims | 92/53 |
| 6,450,083 B1 | * | 9/2002 | Dawson | 92/53 |

FOREIGN PATENT DOCUMENTS

| | | | |
|---|---|---|---|
| DE | 2004117 | 3/1970 | |
| DE | 41 08 207 | 9/1992 | |
| DE | 4108207 A1 * | 9/1992 | ..... F15B/15/16 |
| PL | 171839 | 2/1995 | |
| WO | WO 94/11657 | 5/1994 | |

OTHER PUBLICATIONS

Copy of International Search Report from corresponding International Application PCT/US 03/ 06904.
Mobile Cylinders, Product Information, Quick Reference Data & Application Guide, Catalog HY18–0001/US, Copyright 2001, C9804.

* cited by examiner

*Primary Examiner*—Thomas E. Lazo
(74) *Attorney, Agent, or Firm*—Joseph J. Pophal

(57) ABSTRACT

A telescopic cylinder comprised of an outer cylinder, a plurality of decreasing diameter piston/sleeve assemblies concentrically mounted in the outer cylinder for reciprocal axial movement relative thereto, and a plunger assembly concentrically mounted within the innermost one of the piston/sleeve assemblies for reciprocal axial movement relative thereto. The piston/sleeve and plunger assemblies having a piston with at least one lateral hole and at least one lateral passage, respectively, extending into its interior, and in fluid communication with a passage in the outer cylinder for receiving pressurized fluid. Each lateral hole having an orifice surface located at the radially outermost portion of the hole and having a diametral dimension no smaller than the maximum diametral dimension of the hole. Each piston further having at least one longitudinally relieved portion located on its outer circumferential surface extending from a first end towards a second end.

35 Claims, 5 Drawing Sheets

BLEEDERLESS TELESCOPIC CYLINDER

CROSS-REFERENCE TO RELATED CASES

The present application claims the benefit of the filing date of U.S. Provisional Application Ser. No. 60/361,843, filed Mar. 5, 2002.

FIELD OF THE INVENTION

This invention is directed generally to cylinders and more particularly to bleederless telescopic cylinders having a plurality of piston/sleeve assemblies mounted in telescopic relation.

BACKGROUND OF THE INVENTION

Currently available telescopic cylinders typically include single and double acting types that are extendible upon the introduction of pressurized fluid. Fluid enters a port in an outer cylinder and continues through passages within multiple internal stages of the cylinder. These stages are comprised of coaxial piston/sleeve and plunger assemblies that move relative to the outer cylinder. Erratic fluid flow and trapped air within the cylinder provide obstacles to a desired smooth extension and retraction of the cylinder.

In certain prior art constructions pertaining to telescopic devices, such as U.S. Pat. No. 5,072,811 to Everhard; U.S. Pat. No. 5,322,004 to Sims, and DE Published Application. No. 2,004,117 to Nummi Oy, fluid travels between stages through radial apertures in the sleeve, or tube portions of the assemblies. One disadvantage of these constructions includes weakening the strength of the assemblies by having these apertures extending radially through the thin sleeves. The present invention places fluid apertures or passages in the pistons, which are of greater radial extent than the sleeves. This not only provides the present invention a structurally sounder assembly, but also allows for an orifice at an end of the aperture to be shaped or contoured, thus providing a more laminar flow.

Trapped air within the cylinder can cause sponginess, due to the compressability thereof, that is detrimental to the extension or retraction of the cylinder. In other prior art constructions, such as U.S. Pat. No. 732,142 to Tuggle et al., the cylinder bleeds trapped air out to the atmosphere through apertures in each stage. The present invention is designed without a bleeding orifice or valve due to the minimal amount of air trapped inside the cylinder. This bleederless feature is possible due to the low volume of fluid inside the cylinder and efficient sealing that prevents air from entering the cylinder. The volume of fluid within the cylinder has been reduced since the annular volume between the several stages is kept to a minimum. U.S. Pat. No. 2,692,584 to Armington et al. discloses a telescopic cylinder with a large annular volume between stages which has the potential of trapping more air in the system.

Prior art designs have improved laminar fluid flow in the cylinder by selectively removing material from the sealing rings or sliding bearings on the piston heads so that fluid can more readily flow from one end of the piston to the other. Parker Hannifin Corporation, the assignee of the present invention, uses bearings with circumferentially spaced longitudinal grooves so that the fluid pressure drop, from one side of the piston to the other is reduced. This type of bearing design is well known in the art.

SUMMARY OF THE INVENTION

The present invention has provided a telescopic cylinder having a smoother extension and retraction by adding: radial apertures in the pistons, an orifice to an end of the radial aperture, an annular groove on the peripheral surface of the piston, and longitudinal grooves to the outer surface of the piston. These features have provided a more laminar flow of the fluid inside the telescopic cylinder, a more fluent movement of the cylinder stages, and a quicker extension and retraction of the multiple stages.

More specifically the present invention has provided a telescopic cylinder comprised of an outer cylinder, a plurality of decreasing diameter piston/cylinder assemblies, and a plunger assembly. The outer cylinder has an open end, a closed end and at least one passage, transversely disposed in the outer cylinder through the cylinder wall, in communication with the interior of the outer cylinder and adapted for connection with a source of pressurized fluid. The plurality of decreasing diameter piston/sleeve assemblies is successively concentrically mounted in the outer cylinder for reciprocal axial movement relative to the outer cylinder. Each of the plurality of piston/sleeve assemblies are comprised of a cylindrical sleeve, having a first end and a second end, an annular piston having a first end and a second end which is sealingly attached to the first end of the cylindrical sleeve. The annular piston has at least one lateral hole being in fluid communication with the at least one passage of the outer cylinder. The plunger assembly is concentrically mounted within the innermost one of the plurality of piston/sleeve assemblies for reciprocal axial movement relative thereto. The plunger assembly is comprised of a sleeve, having a first end and a closed second end, and a cylindrical piston, having a first end and a second end that is attached to the sleeve first end. The cylindrical piston has at least one lateral passage, extending from the plunger piston outer peripheral surface laterally inwardly into the interior of the plunger piston. The at least one lateral passage is in fluid communication with the at least one lateral hole in the innermost one of the piston/sleeve assemblies.

Another feature of the noted telescopic cylinder identifies the at least one lateral hole in each annular piston as a radial hole extending from the outer surface to the inner surface, and the at least one lateral passage in the cylindrical piston as a radial hole extending substantially radially inwardly toward the longitudinal axis of the cylindrical piston. An added attribute of the noted telescopic cylinder includes the telescopic cylinder being a single acting push type.

A further feature of the noted telescopic cylinder has the at least one lateral hole and the lateral passage including an orifice surface located at their radially outermost portion. The orifice surface has a minimum diametral dimension no smaller than the maximum diametral dimension of the at least one lateral hole and lateral passage. Yet another feature of the cylinder includes the orifice surface of the at least one lateral hole and lateral passage having a frustoconical shape, or alternatively a contoured shape, and still further having the contoured shape being concave. Another attribute includes having the orifice surface of the lateral hole and lateral passage being of similar shapes. Another feature includes having the orifice of the lateral hole and lateral passage being of a similar size.

Another feature of the noted telescopic cylinder has each of the annular pistons and the cylindrical piston including at least one longitudinally relieved portion, located in the outer peripheral surface of the pistons and extending from the first end towards the second end. The at least one longitudinally relieved portions of the pistons extend longitudinally inwardly to at least the longitudinally outermost surface portion of the at least one lateral hole and lateral passage. Still yet the at least one longitudinally relieved portions of the pistons are circumferentially equidistant from adjacent ones of the at least one longitudinally relieved portion. Further the at least one longitudinally relieved portion of the pistons can take the form of a plurality of equally peripherally spaced longitudinally extending scalloped portions. Another feature has each of the at least one lateral holes of the annular piston and the at least one lateral passage of the cylindrical piston being at least partially circumferentially aligned with the at least one longitudinally relieved portion.

Still another feature of the noted telescopic cylinder includes having the pistons with a pair of longitudinally spaced parallel circular radial grooves located in the outer peripheral surface of the pistons between the first and second ends. Yet another feature includes having one of the pair of longitudinally spaced parallel circular grooves, when viewed in cross-section, being a concave circular radial groove. Another attribute of the present invention includes the orifice having a contoured surface and being at least partially co-extensive with the concave groove. Another feature includes having the other of the pair of circular grooves being flat and retaining an annular bearing sleeve. Also another feature has the flat groove adjacent to the first end of the piston. A further feature includes having the at least one longitudinally relieved portion of the pistons extending through one of the pair of parallel circular radial grooves and into the other of the pair of grooves.

A further feature of the noted telescopic cylinder includes having the open end of the outer cylinder and each of the second ends of the cylindrical sleeves of the plurality of piston/sleeve assemblies having a stop ring attached to its inner surface, and the plunger sleeve and each of the plurality of cylindrical sleeves having an overlap collar attached to its outer surface for abutting contact with the stop ring of the next larger one of the sleeves and outer cylinder during maximum extension of each piston/sleeve assembly. Another feature includes having the overlap collar on each of the plurality of cylindrical sleeves being positioned at any longitudinal location between the first and second ends and having the overlap collar on the plunger assembly being positioned at any longitudinal location between the first end and second closed end for stroke length purposes.

Yet still another feature of the present invention includes having the at least one longitudinally relieved portions in the annular pistons being parallel with the relieved portions in the cylindrical piston. Another attribute of the noted invention includes having a longitudinal passage having a first end located at the cylindrical piston first end and a second end in fluid connection with each of the at least one lateral passages. A further feature has the minor axis of the longitudinal passage being greater than the minor axis of each of the at least one lateral passages in the plunger piston.

DETAILED DESCRIPTION OF THE PREFERRED EMBODIMENT

Figure 1:
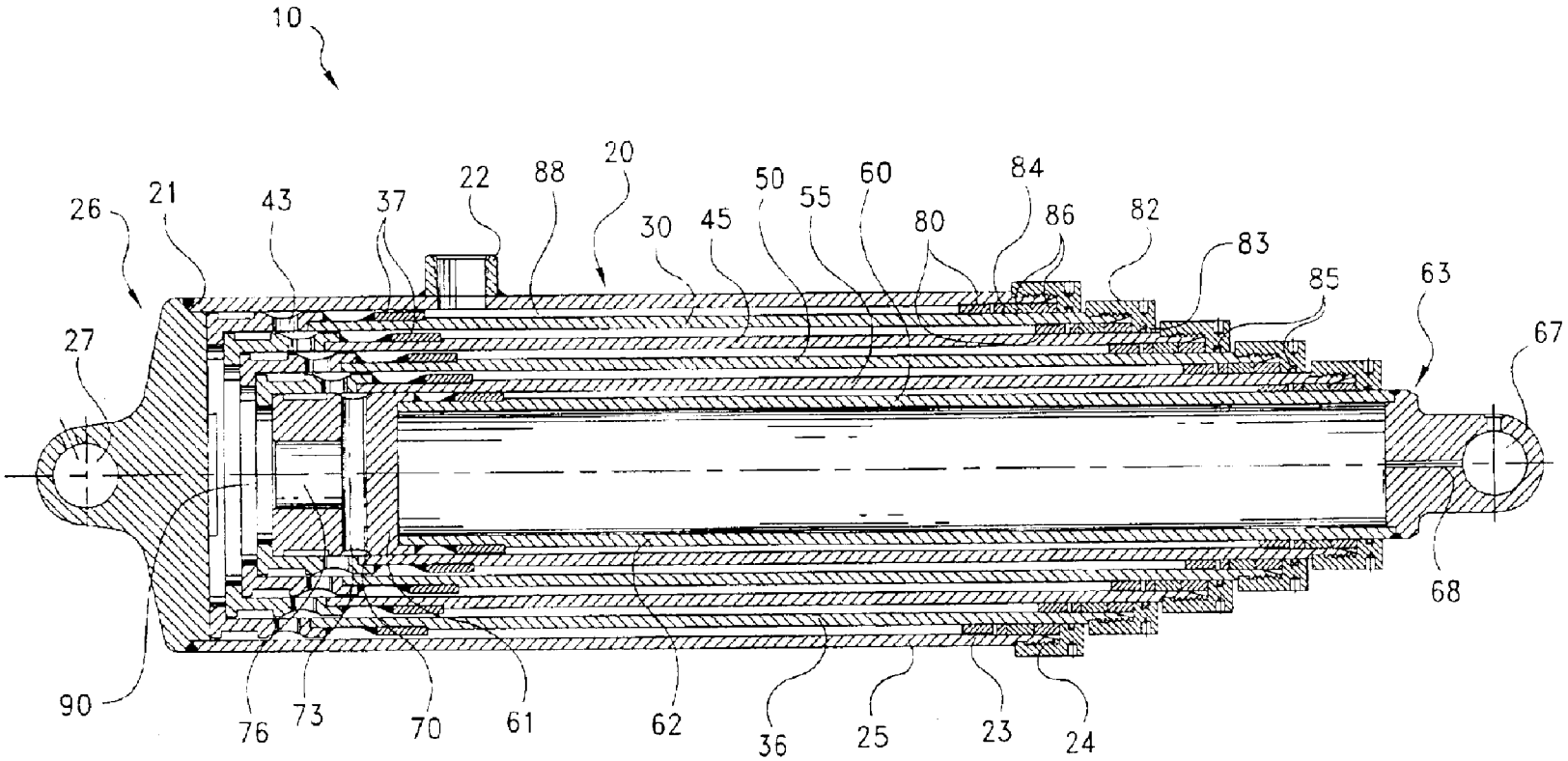
FIG. 1 is a longitudinal cross-sectional view of a telescopic cylinder embodying the present invention.

Referring to the drawings and particularly to FIG. 1, a preferably substantially metallic telescopic cylinder 10, according to the present invention, is shown. Telescopic cylinder 10 has a main cylinder 20 which surrounds a plurality of telescoping concentrically mounted piston/sleeve assemblies including an innermost plunger assembly 60 and intermediate piston/sleeve assemblies, or stages, 30, 45, 50, and 55.

Main cylinder 20 is closed at a first, or base, end portion 21 by a first, or base, end fitting 26 fixedly attached thereto, and is open at its second, or plunger, end portion 25. End fitting 26 can be provided with an integral mounting hole 27 for attachment to a piece of equipment, e.g. the chassis of a dump truck having a pivotable a dump body. Alternatively, other mounting means can be used, for example a trunnion mount can replace mounting hole 27. An inlet/outlet port 22, for receiving and exhausting working fluid, is located on and extends radially through the wall of main cylinder 20. Near its open second end portion 25, main cylinder 20 is provided with an internally threaded portion 23 and a laterally spaced externally threaded portion 24. An externally threaded stop ring 80 is attached to main cylinder 20 via its internally threaded portion 23. An internally threaded packing nut 82 is attached to main cylinder 20 via its externally threaded portion 24 and includes a radially inwardly depending annular lip portion 83 extending over second end portion 25. A seal 84 and two bearing rings 86 are positioned between stop ring 80 and packing nut lip portion 83, respectively. A rod wiper 85 is positioned by annular, lip portion 83 and contacts the outer surface of an inner adjacent assembly sleeve 36. Both stop ring 80 and packing nut 82 have a buttress thread design, which provides a greater resistance to forces such as shear loads (when compared with other forms of threads, for example "V" threads) that are common on telescopic cylinders, particularly during the extension of each assembly. Thus, stop ring 80 can handle greater loads and provides better support for adjacent assembly sleeve when the threads on telescopic cylinder 10 is subjected to shear loads.

Figure 2:
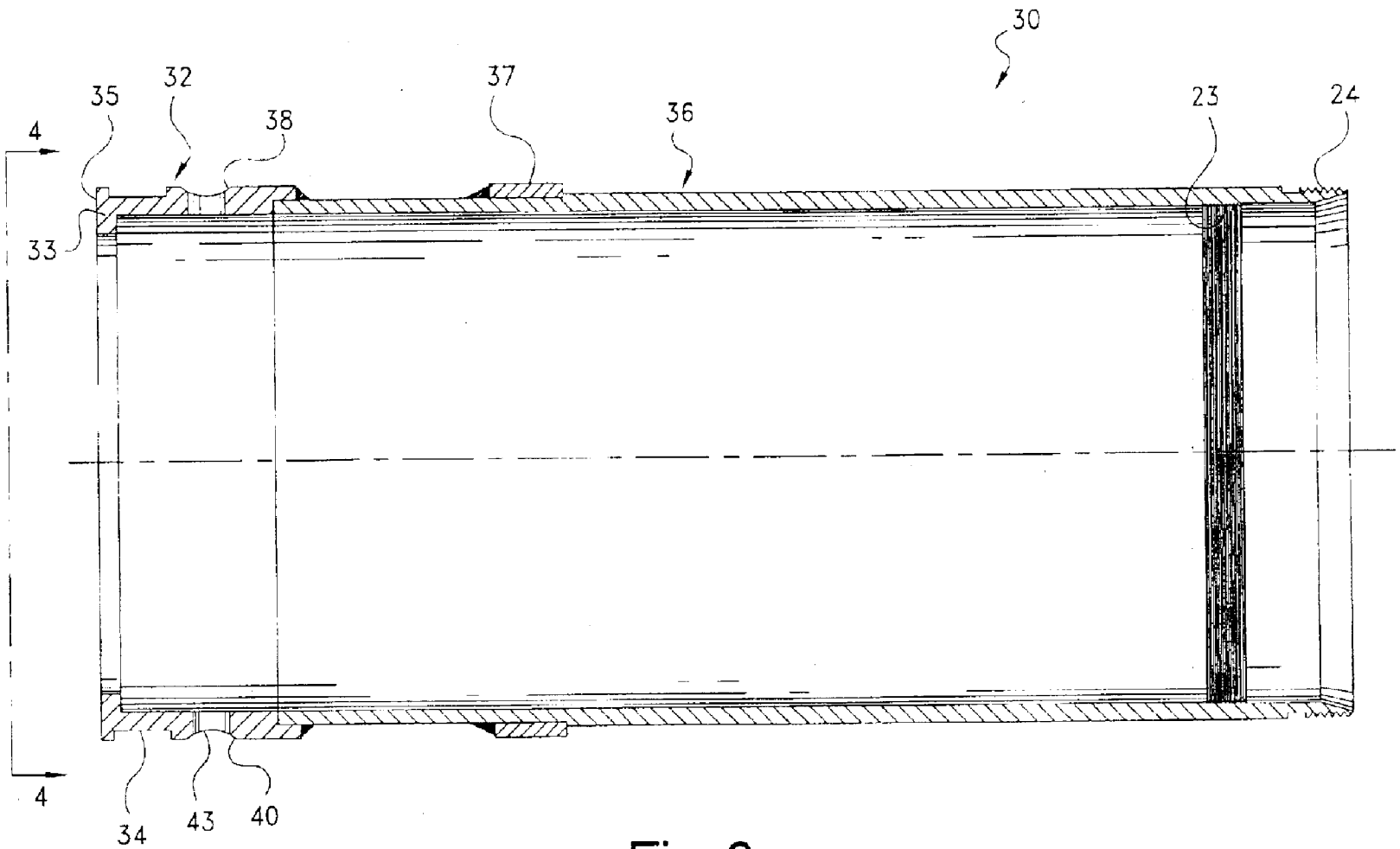
FIG. 2 is a longitudinal cross-sectional view of a piston/sleeve assembly of the present invention.

FIG. 2 details intermediate piston/sleeve assembly 30, which consists of an annular piston 32 fixedly and sealingly attached to the cylindrical annular sleeve 36. The configurations of inward intermediate piston/sleeve assemblies 45, 50 and 55 are similar to assembly 30 such that the elements shown on assembly 30 are similar to the other assemblies except for the decreasing diameters, respectively. Since the construction of each of the intermediate assemblies is substantially similar to that of piston/sleeve assembly 30 except for the dimensions, the elements of remaining piston/sleeve assemblies, 45, 50 and 55, will not be discussed in detail. Annular piston 32 is attached (e.g. by a weld) to cylindrical sleeve 36 and forms one end of assembly 30. Similar to main cylinder 20, cylindrical sleeve 36 has an internally threaded portion 23 and an externally threaded portion 24 on the end opposite annular piston 32. Internal threaded portion 23 mates with stop ring 80 (not shown) and externally threaded portion 24 mates with packing nut 82 (also not shown). As with main cylinder 20, seal 84 and bearing rings 86 are positioned between stop ring 80 and packing nut lip portion 83 (not shown). An overlap annular collar 37 is located between piston 32 and threaded portion 23, and is situated on the outer surface of cylindrical sleeve 36. Depending on the desired length of the stroke of piston/sleeve assembly 30, collar 37 may be located close to piston 32, as shown in FIG.

1 (for maximum stroke) or somewhat longitudinally spaced therefrom, as shown in FIG. 2 (for a reduced-length stroke).

Figure 4:
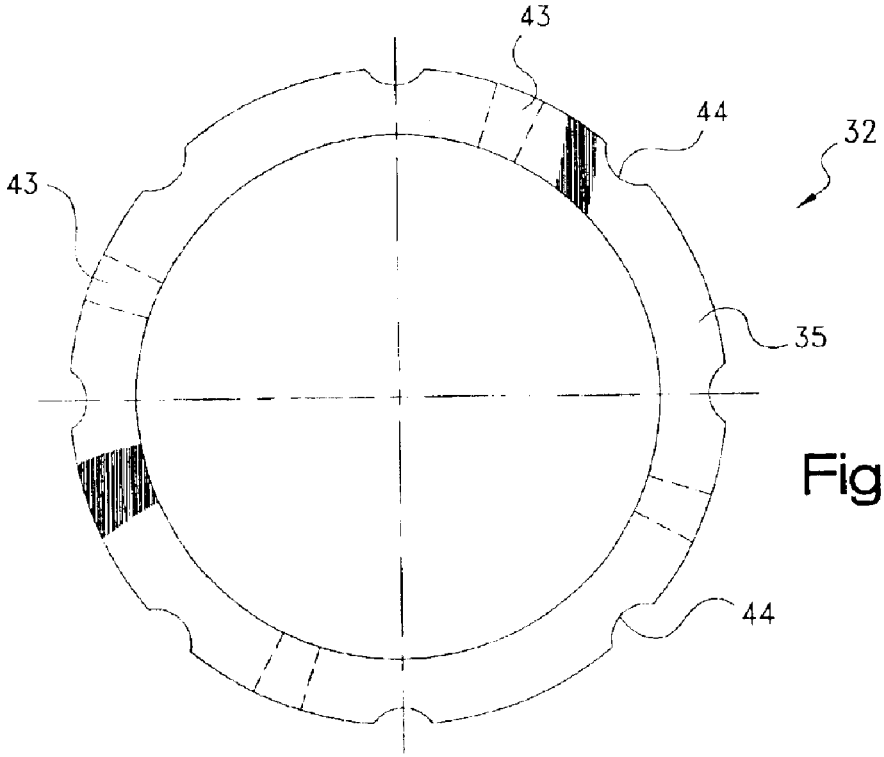
FIG. 4 is a frontal view of an annular piston of the piston/sleeve assembly taken along the lines 4—4 in FIG. 2.
Figure 5:
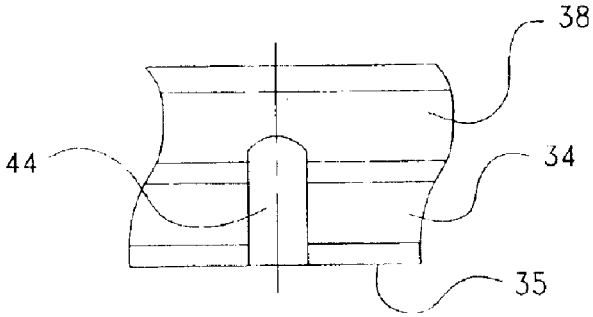
FIG. 5 is a partial, top view of the annular piston detailing a relieved portion in the outer surface.

Annular piston 32 has an inwardly directed radial shoulder portion, or piston lip, 33 located at one longitudinal end, which is also one longitudinal end of piston/sleeve assembly 30. A first, radial, preferably flat, groove 34 is formed in the outer peripheral surface portion of piston 32 adjacent to piston outermost edge 35 and functions to retain a piston bearing ring (not shown). As best shown in FIG. 5, a second, radial contoured, preferably concave, groove 38 is provided in the outer surface of piston 32, longitudinally inwardly of and parallel with first groove 34. The outer surface of piston 32, within concave groove 38, is also provided with at least one radial orifice 40. Each orifice 40, in turn, leads to a lateral or radial flow hole 43 that extends laterally through the wall of piston 32 to the inner surface thereof. Each orifice 40 has a diameter larger than its respective flow hole 43 and can have a frustoconical shape. By virtue of its location in concave groove 38 and an edge radiusing procedure, the surface of orifice 40 is rounded, chamfered, relieved, or contoured with smoothed edges blending into flow hole 43 and groove 38 (and has an outer diameter larger than that of groove flow hole 43). Referring to FIGS. 4 and 5, annular piston 32 is provided with at least one axially or longitudinally-directed rounded or concave groove, scallop, relieved portion or recess 44 in its peripheral surface. Grooves 44 extend longitudinally from piston outermost edge 35, through radial groove 34, into concave groove 38.

Figure 3:
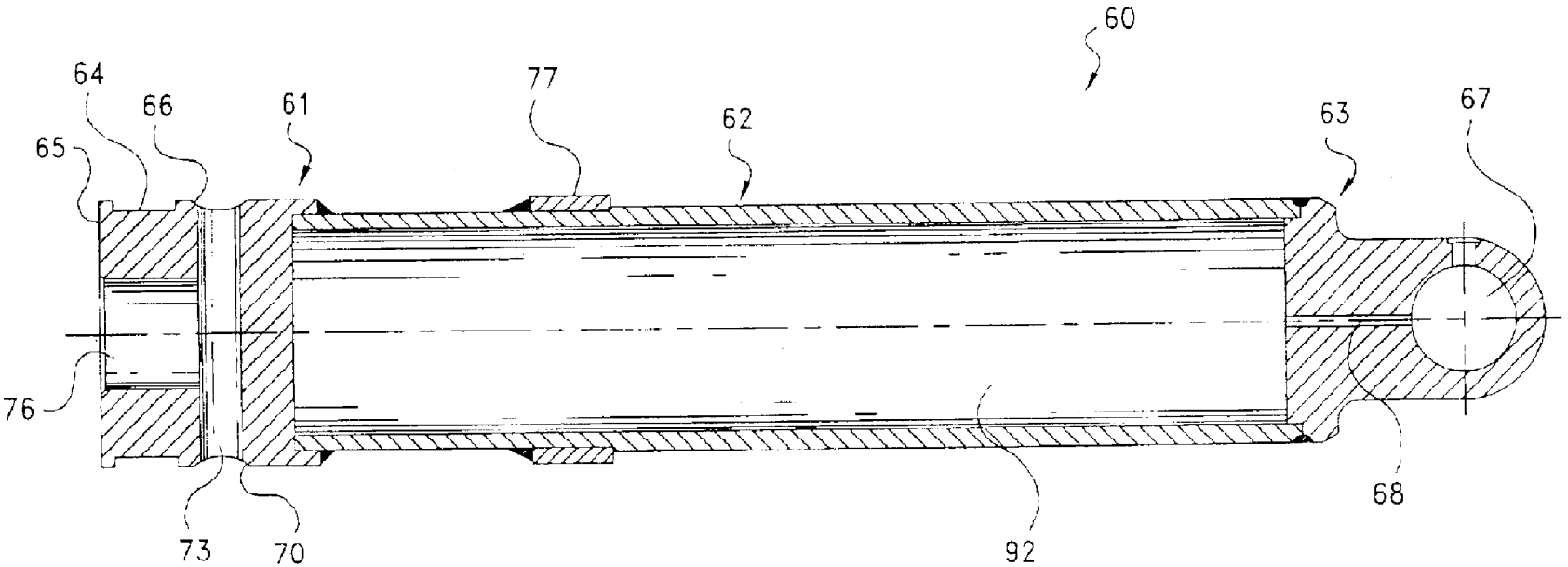
FIG. 3 is a longitudinal cross-sectional view of a plunger assembly of the present invention.

Referring now to FIG. 3, innermost plunger assembly 60 is shown in detail and is comprised of circular or disc-style plunger piston 61, plunger sleeve 62, and a second attachment or end fitting 63 provided with an integral mounting hole 67. Piston 61 and end fitting 63 are sealingly affixed to opposite ends of sleeve 62 by any desired means, which here take the exemplary form of a weld, with mounting hole 67 serving for attachment, for example, to a pivotable dump body of a dump truck. Similar to previously-described sleeve 36, and all intermediate assembly sleeves, plunger sleeve 62 is provided with an overlap collar 77 located axially between plunger piston 61 and end fitting 63, and is fixedly located on the outer surface of plunger sleeve 62. Plunger sleeve 62 forms the outer wall of a cylindrical inner chamber 92 that is sealingly closed off at its longitudinal ends by piston 61 and end fitting 63, thus preventing any fluid from entering inner chamber 92. The closure of inner chamber 92 reduces the amount of potential air space in telescopic cylinder 10 and the amount of fluid needed to fill same. Disc-style or cylindrical plunger piston 61, similar to annular piston 32, is provided with a first radial flat groove 64 in its outer peripheral surface for retaining a piston bearing ring (not shown) as well as a second, radial concave groove 66 parallel with first groove 64. Also similar to annular piston 32, plunger piston 61 is also provided with at least one radial orifice surface 70 leading to a coaxial lateral, or radial, flow hole 73, the radially inner end of which is connected to a flow passage 76 that extends longitudinally or axially to an outer edge surface 65 of plunger piston 61. The diameter, or minor axis, of flow passage 76 is greater than the diameter of flow hole 73. Orifice 70 is rounded, chamfered, relieved, or contoured with smoothed edges blending into flow hole 73 and radial concave groove 66. Each orifice 70 has a diameter larger than that of flow hole 73 and can have a frustoconical shape. Also similar to annular piston groove 44, plunger piston 61 is provided with at least one similar longitudinally-directed rounded or concave groove, scallop, relieved portion or recess, (not shown) in its outer peripheral surface. This groove or grooves extend(s) from piston outer edge surface 65 through radial groove 64, into concave groove 66.

Portions of plunger assembly 60 are provided with corrosion resistant coating, an example of which is a nitro carborized finish. When telescopic cylinder 10 is fully extended, plunger assembly 60 is at its greatest extension and comes in contact with outside contaminants. In prior art designs, exposure to these contaminants revealed that the portion of plunger assembly 60 (located from overlap collar 37 to second end fitting 63) to be the component of a telescopic cylinder most likely to experience corrosion problems. Also adding to the corrosion of plunger assembly 60 is that the section between seal 84 and end fitting 63 is not exposed to internal oil. Therefore, the noted coating provides the desired corrosion protection. For example, as part of the carborizing finish process, plunger assembly 60 is placed in an appropriate salt bath or nitrogen gas chamber. The finish penetrates the outer surface of plunger assembly 60. Since plunger assembly 60 is hollow, pressure builds within the hollow area during the carborizing process which is reduced through a relief hole 68, in end fitting 63, which is subsequently sealed. If desired, all of the ferrous components and assemblies of telescopic cylinder 10, exposed to outside contaminants, can be provided with a corrosion-resistant coating in the same or similar manner.

Referring again to FIGS. 2, 3 & 4, as an example of the present invention, annular piston 32 has four orifices 40 and coaxial reciprocating radial flow holes 43 positioned or terminating within radial concave groove 38. Orifice 40 and their associated reciprocating flow holes 43 are preferably spaced at 90° intervals around the circumference of piston 32. As previously noted by virtue of their location within concave circular groove 38 and the subsequent edge radiusing of orifices 40, the latter blend smoothly into flow holes 43. As best seen in FIG. 4, the outer periphery of piston 32 is provided with eight, preferably equally spaced, rounded or concave grooves, relieved portions or scallops, 44 in its outer circumferal surface. Preferably, the diametral spacing of the four flow holes 43, relative to the eight concave grooves 44 is such that holes 43 are equally circumferentially spaced between adjacent ones of some of grooves 44. Alternately, holes 43 could be circumferentially aligned with alternating grooves 44. Similarly, plunger piston 61 is provided with four orifices 70 and reciprocating flow holes 73 positioned within radial concave groove 66. Orifices 70 and reciprocating flow holes 73 are preferably spaced at 90° intervals. All four radial flow holes 73 lead into axial flow passage 76. The outer periphery of piston 61 is provided with eight, preferably equally spaced, rounded grooves, relieved portions or scallops (not shown) in its outer peripheral surface. Again, the diametral spacing of the four flow holes 73, relative to the eight concave rounded grooves (not shown since they are similar to grooves 44) is such that holes 73 are preferably equally circumferentially spaces between some adjacent ones of the concave grooves. Alternatively, holes 73 could be partially circumferentially aligned alternating rounded grooves.

Referring back to FIG. 1, the operation of the present invention will now be discussed. It should be noted that during operation, all open spaces in telescopic cylinder 10, when retracted, are filled with fluid. It is only upon the very first or initial start-up that air occupies any of the open spaces in telescopic cylinder 10, which air is purged at that time. Therefore, the extending operation of telescopic cylinder 10 will address typical operation when fluid is present in all areas. In order to extend telescopic cylinder 10, pressurized or working fluid is supplied by a typical external source (not shown) into inlet port 22 and causes occupying fluid in an annular space 88, between main cylinder 20 and intermediate piston/sleeve assembly 30, to move through flow hole 43. Fluid travels in this manner through each of flow holes 43 in remaining intermediate piston/sleeve assemblies 45, 50, and 55 before flowing through radial hole(s) 73 and longitudinal passage 76 in plunger piston 61. Fluid then flows into a space 90, between end fitting 26 and assemblies 30, 45, 50, 55, and 60, thereby increasing the fluid pressure within telescopic cylinder 10. When the fluid pressure is sufficient to overcome the weight of the equipment (being actuated), intermediate piston/sleeve assembly 30, and assemblies 45, 50, 55, and 60 which are nested within assembly 30, move longitudinally relative to main cylinder 20, in the direction of end fitting 63. Piston/sleeve assembly 30, and nested assemblies 45, 50, 55, and 60, continue to axially move, relative to main cylinder 20, until stop ring 80, attached to the interior of main cylinder 20, is contacted by overlap collar 37 of piston/sleeve assembly 30. During the movement of piston/sleeve assembly 30 relative to the main cylinder 20, annular space 88 begins to decrease causing the fluid therewithin to be forced through flow hole 43 or past grooves 44, joining the flow of the working fluid. When stop ring 80 is contacted by overlap collar 37 of piston/sleeve assembly 30, intermediate assembly 45, begin to move together with assemblies 50, 55 and 60 relative to main cylinder 20 and piston/sleeve assembly 30. Like the previously described movement of piston/sleeve assembly 30 relative to main cylinder 20, the movement of piston/sleeve assembly 45 occurs until the stop ring 80 on piston/sleeve assembly 30 is contacted by overlap collar 37 on piston/sleeve assembly 45. As long as pressurized fluid is supplied to telescopic cylinder 10, piston/sleeve assemblies 50, 55, and plunger assembly 60 will follow in the same previously described manner until telescopic cylinder 10 is fully extended.

Each moving sleeve or piston/cylinder assembly provides a different lifting force depending on the area of the moving sleeve or assembly. For example, piston/sleeve assembly 30 has a greater outer diameter than the other assemblies, 45, 50, 55 and 60. If a constant fluid pressure is supplied, the lifting force from assembly 30 will be the greatest due to relationship of force and area (i.e.: force=pressure×area). When piston/sleeve assembly 45 begins to move, the decrease in lifting force will be proportional to the cross-sectional area defined by the outer diameter of the sleeve. Since the cross-sectional area of its sleeve is not as great as the cross-sectional area of the sleeve of assembly 30, the lifting force supplied by moving assembly 45 is not as great as the initial lifting force supplied by assembly 30. Likewise, as the cross-sectional areas of the remaining assemblies (50, 55, and 60) decrease, the additional lifting force also decreases. The extension speed of telescopic cylinder 10 increases with the decreasing cross-sectional piston areas of the assemblies' sleeve. For example, if a constant volume of fluid is supplied to telescopic cylinder 10, the extension speed remains constant while assembly 30 is moving alone, then increases when piston/sleeve assembly 45 begins to move since the volume of fluid needed to move assembly 45 (compared to piston/sleeve assembly 30) is less. The extension speed will proportionally increase with the decrease in cross-sectional area of each moving assembly.

Retraction of telescopic cylinder 10, which is shown as a push-type single acting cylinder, is performed by gravitational force and/or by the force supplied by the weight of the item being actuated. If telescopic cylinder 10 is fully extended, plunger assembly 60 is the first assembly to be returned to or pushed to its at-rest position by forcing fluid from space 90 out of port 22. Since plunger assembly 60 is moving and has passages built therewithin, fluid will also flow from space 90 into flow passage 76, through flow hole 73, into annular space 90 (which is beginning to fill with fluid), as well as through successive flow holes 43 in each annular piston 32, and finally out of cylinder 10 via port 22. Upon full retraction of plunger assembly 60, outer edge surface 65 contacts the inner surface of inwardly directed shoulder 33 of piston/sleeve assembly 55, causing piston/sleeve assembly 55 to retract. When piston/sleeve assembly 55 moves with plunger assembly 60, fluid again travels from space 90 and out port 22. Again, since piston/sleeve assembly 55 and plunger assembly 60 have passages built within, fluid will also flow from space 90 into passage 76, through flow hole 73, through flow holes 43 in annular piston 32 of piston/sleeve assemblies 55, into annular space 90, as well as through flow holes 43 in each annular piston 32 of assemblies 50, 45, and 30, and out port 22. Annular piston outermost edge surface 35 of assembly 55 contacts the inner surface of inwardly directed shoulder 33 of piston/sleeve assembly 50, causing assembly 50 to retract. Fluid will once again flow as described above and the retraction continues until telescopic cylinder 10 is fully retracted, as shown in FIG. 1.

Figure 6:
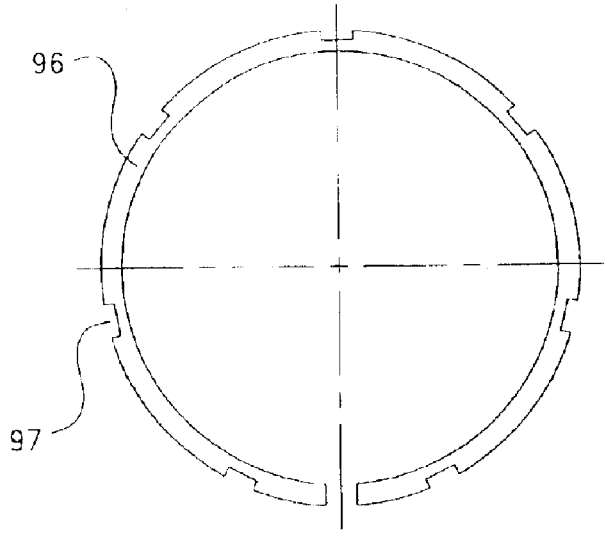
FIG. 6 is a frontal view of a bearing ring.

It should be noted that during movement of each assembly, 30, 45, 50, 55, and 60, rounded longitudinal grooves, or scallops, 44 in the piston peripheral surface provide multiple parallel paths for the working fluid. As shown in FIG. 6, similar longitudinal grooves 97 are also provided in the outer peripheral surfaces of bearing rings 96 located in flat radial grooves 34 of the noted assemblies. Grooves 97 function in a manner similar to those of grooves 44. Since working fluid is thus able to flow past pistons 32 and 61 more readily, the assemblies have a smoother and more fluent motion. Due to ready fluid flowing past pistons 32 and 61, the fluid pressure drop from one end of the piston to the other is reduced. Without grooves 44 in the pistons (and grooves 97 in bearing ring 96), the noted assemblies have a slower response time while the pistons of assemblies 30, 45, 50, 55, and 60 are positioned between first end fitting 26 and port 22 (due to a greater fluid pressure drop) and a longer retraction time cycle. During extension of telescopic cylinder 10, when outermost piston/sleeve assembly 30 begins to move, the pressurized or working fluid flows from annular space 88, past piston 32, and into space 90, as well as through holes 43 into space 90. Piston grooves 44 provide a pathway for the fluid that ensures a constant, smooth flow, with similar grooves 44 in the other pistons, including plunger piston 61, providing a similar fluid pathway. During retraction, from a fully extended position, fluid flows from space 90 into passage 76, through holes 73 in plunger piston 61, into expanding annular space 88, as well as through successive holes 43 in each annular piston 32, past grooves 44 and back into space 90. With the decreasing volume inside of cylinder 10, fluid is also exiting from port 22. Without plunger piston grooves 44, fluid would enter the annular space between plunger sleeve 62 and the sleeve of assembly 55, and would not have a smooth or fluent path to exit. When piston/sleeve assembly 55 begins to retract, fluid flows from space 90 into passage 76, through piston holes 73, through holes 43 in annular piston 32 of assembly 55, into expanding space 88 (between the sleeves of assemblies 55 and 50), as well as through successive holes 43 in annular pistons 32 of assemblies 50, 45, and 30, past grooves 44 in annular pistons 32, and back into space 90. As stated above, with the decreasing volume inside of cylinder 10, fluid is also exiting via port 22. A similar flow path exists for retraction of each remaining assembly. The addition of grooves 44 not only permits a smoother retraction (due to the reduced fluid pressure drop), but also a quicker retraction (shorter time cycle).

Figure 7:
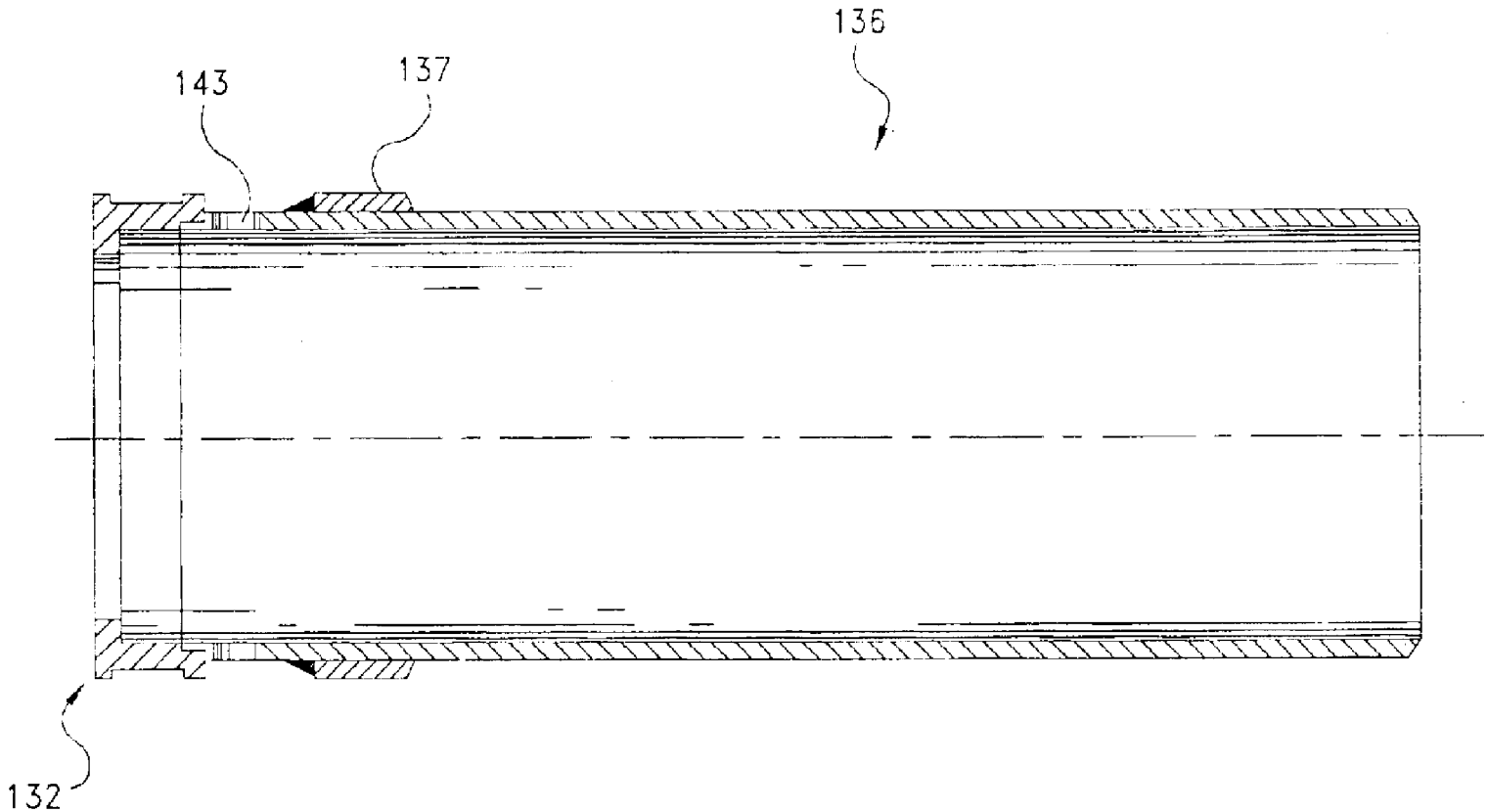
Fig. 7 (PRIOR ART)
FIG. 7 is a longitudinal cross-sectional view of a prior art piston/sleeve assembly.

As shown in FIG. 7, prior art piston/sleeve assemblies utilized flow holes 143 that were located in assembly sleeve 136 rather than being located in piston 132, as is the case in the present invention. Due to the location of flow hole 143 in sleeve 136, the strength of a prior art telescopic cylinder was impaired. Furthermore, due to the thin wall thickness of sleeve 136, machining a plurality of wide axial orifices adjacent to flow holes 143 is impractical from both the machining and strength standpoints. The present invention can, not only put a wider orifice, 40 and 70, on one of flow holes 43 and 73, but also configure the orifice to the desired radius. Machining pistons 32 and 61, rather than sleeves 36 and 62, greatly simplifies the manufacture of telescopic cylinder 10. Having a flow hole in plunger sleeve (not shown) rather than plunger piston, as is the case in the present invention, allows for fluid to enter the inside of plunger sleeve, which adds unnecessary weight (via the fluid therein) and provides a space for air entrapment within the telescopic cylinder.

As previously noted, the placement of flow holes 43 and 73 in pistons 32 and 61, respectively, rather than in the assembly sleeves, enables the present invention to include the addition of wide profile orifice surfaces, 40 and 70, at one end of flow holes 43 and 73, respectively. Due to the radial thickness of plunger piston 61 and each annular piston 32 versus the thickness of assembly sleeves, the annular surfaces of orifices 70 and 40 can be shaped or configured with specific flow profiles, if so desired. Stated in another way, the annular orifice surface can be profiled by varying the radii thereof. Widened annular orifices 40 and 70 allow a more laminar flow of the fluid entering and exiting holes 43 and 73 at their orifices, respectively. Greater laminar fluid flow within telescopic cylinder 10 allows smoother movement of each assembly during extension and retraction, thus providing more consistent operation of cylinder 10 together with reduced cycle times. Positioning annular orifices 40 and 70 within radial circular concave grooves 38 and 66 so that the contoured surface of orifices 40 and 70 are at least partially coextensive with concave grooves 38 and 66 also adds to a more laminar flow of fluid through telescopic cylinder 10.

The present invention provides a structurally stronger telescopic cylinder 10 without adding any weight (compared with a similar sized cylinder). As described earlier, since flow hole 73 has been moved from plunger sleeve 62 to plunger piston 61, the integrity of plunger sleeve 62 is not impaired and no fluid is harbored therein. Thus, hollow plunger sleeve 62 does not have the added weight from fluid that was previously required to fill same. Telescopic cylinder 10 also has saved weight by changing the profile of first end fitting 26. The structure close to mounting hole 27 has been optimized in order to thin out and lighten end fitting 26. The weight saved via hollow plunger sleeve 62 and the thinning of end fitting 26 is redistributed into assembly sleeves, 36 and 62 in the form of greater wall thicknesses thereof. Thicker sleeves provide a structurally stronger telescopic cylinder 10 that is able to withstand higher fluid pressures as well as providing a greater safety margin. The weight saved with hollow plunger sleeve 62 and the thinning of end fitting 26 is also redistributed into larger diameter assemblies. As noted above, a larger diameter will provide a greater lifting force.

The use of hollow plunger assembly 60 and the reduced annular spaces between adjacent sleeves 36 combine to minimize the available volume for fluid. Not only does this reduce the weight of telescopic cylinder 10, as described above, but it also reduces the available space for undesired air retention. When undesired air is present inside telescopic cylinder 10, movement of cylinder 10 is less fluent, or spongy, subjecting the piece of equipment being actuated to uneven and erratic movement. During initial installation of telescopic cylinder 10 or replacement of any component, e.g. filters, air is introduced to the system. In prior art designs, a bleeder valve was attached to the top of the telescopic cylinder so that a user could "bleed off" or purge any trapped air. This purging step presented several undesirable requirements, namely the required bleeding action at the cylinder and the attachment of a conduit from the bleeding port to the chassis so that the user could remove the air. A recently performed air bleed test on the present invention determined that air was removed from telescopic cylinder 10 within three working cycles (cycle=extension+retraction) of an installed cylinder. This "bleederless cylinder" designation is derived from the lack of available space, for undesired air accumulation, within telescopic cylinder 10.

It should be noted that the present invention is not limited to the specified preferred embodiments and principles. Those skilled in the art to which this invention pertains may formulate modifications and alterations to the present invention. These changes which rely upon the teachings by which this disclosure has advanced are properly considered within the scope of this invention as defined by the appended claims.

What is claimed is:

1. A multi-stage telescopic cylinder comprising:

an outer cylinder having an open end, a closed end and at least one radial passage disposed through the wall of said outer cylinder in communication with the interior of said outer cylinder and adapted for connection with a source of pressurized fluid;

multi-telescoping stages, including a plurality of piston/sleeve assemblies of successively differing diameters, concentrically movably mounted within said outer cylinder for reciprocal longitudinal, sealed movement, said plurality of piston/sleeve assemblies including an innermost plunger assembly, and at least one intermediate piston/sleeve assembly concentrically mounted intermediate said outer cylinder and said innermost plunger assembly, said at least one intermediate piston/sleeve assembly being defined by an sleeve having an piston mounted on one end, said innermost plunger assembly having a hollow sleeve with a cylindrical piston closing one end thereof, said cylindrical piston having a substantially radially disposed passage extending toward the longitudinal axis of said cylindrical piston; and successive internal fluid passages taking the form of a radially disposed hole formed in the walls of said pistons in fluid communication with said at least one passage in said outer cylinder.

2. The telescopic cylinder as in claim 1 wherein said hollow sleeve of said innermost plunger assembly is also closed on another end thereof.

3. The telescopic cylinder as in claim 2 wherein said cylindrical piston further includes a longitudinal passage having a first end located at a first end of said cylindrical piston and a second end in fluid connection with said substantially radially disposed passage in said cylindrical piston.

4. The telescopic cylinder as in claim 1 wherein said cylinder is a single acting cylinder with said one radial passage being disposed near the closed end of said outer cylinder.

5. A telescopic cylinder comprising:

an outer cylinder having an open end, a closed end and at least one passage, transversely disposed in said outer cylinder through said cylinder wall, in communication with the interior of said outer cylinder and adapted for connection with a source of pressurized fluid;

a plurality of decreasing diameter piston/sleeve assemblies successively concentrically mounted in said outer cylinder for reciprocal axial movement relative thereto, each of said plurality of piston/sleeve assemblies being comprised of a cylindrical sleeve having a first end and a second end, an annular piston having a first end and a second end, said annular piston second end being sealingly attached to the first end of said cylindrical sleeve, said annular piston having at least one lateral hole extending into the interior of said piston, said at least one lateral hole being in fluid communication with said at least one passage transversely disposed in the wall of said outer cylinder; and a plunger assembly, concentrically mounted within the innermost one of said plurality of piston/sleeve assemblies for reciprocal axial movement relative thereto, said plunger assembly being comprised of a sleeve, having a first end and a second closed end, and a cylindrical piston having a first end and a second end, said second end being sealingly attached to said sleeve first end, said plunger assembly cylindrical piston having at least one lateral passage, extending from the plunger piston outer peripheral surface laterally inwardly into the interior of said plunger piston, said at least one lateral passage being in fluid communication with said at least one lateral hole in said innermost one of said piston/sleeve assemblies.

6. The telescopic cylinder as in claim 5 wherein said at least one lateral hole in each annular piston is a radial hole extending from the outer surface to the inner surface thereof, and said at least one lateral passage in said cylindrical piston is a radial hole extending substantially radially inwardly toward the longitudinal axis of said cylindrical piston.

7. The telescopic cylinder as in claim 5, wherein said at least one lateral hole and lateral passage include an orifice surface located at the radially outermost portion of said at least one lateral hole and lateral passage, said orifice surface having a minimum diametral dimension no smaller than the maximum diametral dimension of said at least one lateral hole and lateral passage.

8. The telescopic cylinder as in claim 7 wherein said orifice surface of said at least one lateral hole and lateral passage have a frustoconical shape.

9. The telescopic cylinder as in claim 7 wherein said orifice surface of said at least one lateral hole and lateral passage have a contoured shape.

10. The telescopic cylinder as in claim 9 wherein said contoured shape, when viewed in cross-section, is concave.

11. The telescopic cylinder as in claim 5 wherein each of said annular pistons and said cylindrical piston further include at least one longitudinally relieved portion, located in the outer peripheral surface of said annular and cylindrical pistons and extends from said first end towards said second end.

12. The telescopic cylinder as in claim 11 wherein said at least one longitudinally relieved portion of said annular piston and said cylindrical piston extend longitudinally inwardly to at least the longitudinally outermost surface portion of said at least one lateral hole and lateral passage, respectively.

13. The telescopic cylinder as in claim 11 wherein each of said at least one lateral holes of said annular piston and said lateral passage of said cylindrical piston are circumferentially equidistant from adjacent ones of said at least one longitudinally relieved portion.

14. The telescopic cylinder as in claim 11 wherein said at least one longitudinally relieved portion of said pistons takes the form of a plurality of equally peripherally spaced longitudinally extending scalloped portions.

15. The telescopic cylinder as in claim 11 wherein each of said at least one lateral holes of said annular piston and said at least one lateral passage of said cylindrical piston are at least partially circumferentially aligned with said at least one longitudinally relieved portion.

16. The telescopic cylinder as in claim 5 wherein said pistons have a pair of longitudinally spaced parallel circular radial grooves located in the outer peripheral surface of said pistons between said first and second ends.

17. The telescopic cylinder as in claim 16 wherein at least one of said pair of circular radial grooves, when viewed in cross-section, is a concave circular radial groove.

18. The telescopic cylinder as in claim 16 wherein at least one of said pair of parallel circular radial grooves is a flat groove and serves to retain an annular bearing sleeve.

19. The telescopic cylinder as in claim 18 wherein said flat groove is adjacent to the first end of said pistons.

20. The telescopic cylinder as in claim 11 wherein said pistons have a pair of longitudinally spaced parallel circular radial grooves located in the outer peripheral surface of said pistons between said first and second ends and wherein said at least one longitudinally relieved portions of said pistons extend through one of said pair of parallel circular radial grooves and into the other of said pair of parallel circular radial grooves.

21. The telescopic cylinder as in claim 7 wherein said pistons have a pair of longitudinally spaced parallel circular radial grooves located in the outer peripheral surface of said pistons between said first and second ends and wherein one of said pair of parallel circular radial grooves is a concave groove having said orifice surface located therewithin.

22. The telescopic cylinder as in claim 21 wherein said orifice has a contoured surface that is at least partially co-extensive with said concave groove.

23. The telescopic cylinder as in claim 5 wherein said open end of said outer cylinder and each of said second ends of cylindrical sleeves of said plurality of piston/sleeve assemblies has a stop ring attached to its inner surface, and said plunger sleeve and each of said plurality of cylindrical sleeves has an overlap collar attached to its outer surface for abutting contact with the stop ring of the next larger one of said sleeves and outer cylinder during maximum extension of each piston/sleeve.

24. The telescopic cylinder as in claim 23 wherein said overlap collar on each of said plurality of cylindrical sleeves can be positioned at any longitudinal location between said first and said second ends thereof, and said overlap collar of said plunger assembly can be positioned at any longitudinal location between said first end and said second closed end thereof for stroke length control purposes.

25. The telescopic cylinder as in claim 5 wherein said telescopic cylinder is of the single acting push type.

26. A telescopic cylinder comprising:

an outer cylinder having an open end, a closed end and at least one lateral passage extending through said cylinder wall in communication with the interior of said outer cylinder and adapted for connection with a source of pressurized fluid; a plurality of decreasing diameter piston/sleeve assemblies concentrically mounted in said outer cylinder for reciprocal axial movement relative thereto, each of said plurality of piston/sleeve assemblies being comprised of a cylindrical sleeve having a first end and a second end, an annular piston having a first end and a second end, said piston second end being sealingly attached to the first end of said cylindrical sleeve; and a plunger assembly, concentrically mounted within the innermost one of said plurality of piston/sleeve assemblies for reciprocal axial movement relative thereto, said plunger assembly being comprised of a sleeve, having a first end and a second closed end, and a disk-style piston having a first end and a second end, said second end being sealingly attached to said sleeve first end, wherein the improvement comprises:

said annular piston of each of said piston/sleeve assemblies having at least one transverse hole extending through the peripheral wall of said annular piston and being in fluid communication with said at least one lateral passage disposed in said outer cylinder;

said at least one transverse hole in each of said annular pistons having a first orifice surface located at the radially outermost portion of said at least one hole, said orifice surface having a minimal diametral dimension no smaller than the maximum diametral dimension of said at least one hole, said annular piston also including at least one longitudinally relieved first portion, located on the outer circumferential surface of said piston, and extending from said first end towards said second end;

said disk-style plunger piston having at least one lateral passage in fluid communication with said at least one lateral hole in said piston/sleeve assembly, and a longitudinal passage having a first end located at a first end of said disk-style piston and a second end in fluid connection with said at least one lateral passage; and said at least one lateral passage in said disk-style piston having a second orifice surface located at the radially outermost portion of said at least one lateral passage, said second orifice surface having a minimal diametral dimension no smaller than the maximum diametral dimension of said at least one lateral passage, said disk-style piston also including at least one longitudinally relieved second portion, located on the outer circumferential surface of said disk-style piston and extending from said first to said second end.

27. The telescoping cylinder of claim 26 wherein said first and second longitudinally relieved portions of said pistons are parallel.

28. The telescoping cylinder of claim 26 wherein said radial holes are circumferentially aligned with alternating ones of at least one of said first and second longitudinally relieved portions in said pistons.

29. The telescoping cylinder as in claim 26 wherein said first and second orifices are of substantially similar size.

30. The telescoping cylinder as in claim 26 wherein said first and second orifices are of substantially similar shape.

31. The telescoping cylinder as in claim 26 where the minor axis of said at least one longitudinal passage is greater than the minor axis of said at least one lateral passage.

32. The telescoping cylinder as in claim 26 wherein said pistons have a pair of longitudinally spaced parallel circular radial grooves located in the outer peripheral surface of said pistons between said first and second ends.

33. The telescoping cylinder as in claim 32 wherein one of said pair of longitudinally spaced parallel circular radial grooves is a concave groove having said orifice surface located therewithin.

34. The telescoping cylinder as in claim 33 wherein said orifice surface is a contoured surface that is at least partially co-extensive with said concave groove for providing a more laminar flow of fluid through said orifices, said at least one transverse hole, and said at least one lateral passage.

35. The telescoping cylinder as in claim 32 wherein said at least one longitudinally relieved portions extend through one of said pair of longitudinally spaced parallel radial grooves and into the other of said pair of parallel circular radial grooves for increasing fluid flow past said pistons in order to provide a more smooth operation of said telescopic cylinder.

* * * * *